US012582244B2

(12) United States Patent
Mun

(10) Patent No.: US 12,582,244 B2
(45) Date of Patent: Mar. 24, 2026

(54) DISPLAY BOARD AND METHOD OF USE

(71) Applicant: Ivy Enterprises, Inc., Port Washington, NY (US)

(72) Inventor: Eun Su Mun, Bayside, NY (US)

(73) Assignee: Ivy Enterprises, Inc., Port Washington, NY (US)

( * ) Notice: Subject to any disclaimer, the term of this patent is extended or adjusted under 35 U.S.C. 154(b) by 0 days.

(21) Appl. No.: 18/702,735

(22) PCT Filed: Oct. 20, 2022

(86) PCT No.: PCT/US2022/047267
§ 371 (c)(1),
(2) Date: Apr. 18, 2024

(87) PCT Pub. No.: WO2023/069609
PCT Pub. Date: Apr. 27, 2023

(65) Prior Publication Data

US 2025/0228377 A1 Jul. 17, 2025

Related U.S. Application Data

(60) Provisional application No. 63/271,082, filed on Oct. 22, 2021.

(51) Int. Cl.
*A47F 5/08* (2006.01)

(52) U.S. Cl.
CPC ..... *A47F 5/0815* (2013.01); *A47F 5/0823* (2013.01); *A47F 5/083* (2013.01)

(58) Field of Classification Search
CPC .... A47F 5/0815; A47F 5/0006; A47F 5/0018; A47F 5/083; A47F 5/0838; A47F 5/0846; A47F 5/0081; A47F 5/0807; A47F 5/0823; A47F 2005/0075
USPC ..... 211/13.1, 57.1, 59.1; 248/220.31, 248/220.41, 220.42, 225.21
See application file for complete search history.

(56) References Cited

U.S. PATENT DOCUMENTS 2,614,701 A * 10/1952 Mapson ..... A47F 5/0815 248/222.51
3,269,487 A * 8/1966 Larson ..... B25H 1/06 182/155

(Continued)

FOREIGN PATENT DOCUMENTS

CA 3235808 A1 * 4/2023 ..... A47F 5/0815
CN 118139567 A * 6/2024 ..... A47F 5/0815

(Continued)

OTHER PUBLICATIONS

Pierre Kohler, Extended European Search Report on EP Application No. 22884469, Aug. 14, 2025, European Patent Office, The Hague, Netherlands.

*Primary Examiner* — Kimberly S Berona
(74) *Attorney, Agent, or Firm* — Cherskov Flaynik & Gurda, LLC

(57) ABSTRACT

A display system includes a backer board that has an array of apertures. The system also includes at least one display prong designed to be received by the backer board. At least one of the apertures of the array of apertures comprises an aperture having a secure alcove adapted to receive the display prong without requiring the display prong to be tilted.

12 Claims, 9 Drawing Sheets

(56) References Cited

U.S. PATENT DOCUMENTS 3,310,271 A * 3/1967 King ..... A47F 5/0815 248/222.52
3,850,396 A * 11/1974 Orlandi ..... A47F 5/0815 248/220.42
3,880,390 A * 4/1975 Niven ..... A47F 5/0815 248/220.43
3,912,212 A * 10/1975 Betts, Sr. ..... B01L 9/00 248/220.31
4,372,450 A * 2/1983 Licari ..... A47G 25/0678 211/32
4,434,960 A * 3/1984 Berry ..... A47F 5/0815 248/223.31
4,768,660 A * 9/1988 Handler ..... B25H 3/04 248/222.12
5,163,567 A * 11/1992 Betts, Sr. ..... A47L 15/505 211/75
6,789,771 B1 * 9/2004 Shick ..... A63F 13/24 248/309.2
7,284,671 B1 * 10/2007 Doscher ..... A47B 81/005 211/32
8,459,472 B2 * 6/2013 Hofman ..... A47F 5/0815 211/106.01
8,695,816 B2 * 4/2014 Troyner ..... A47B 96/1441 211/187
8,814,108 B2 * 8/2014 Bernstein ..... A47F 5/0823 211/113
8,899,424 B2 * 12/2014 Bayazit ..... H04Q 1/062 248/220.31
9,345,343 B2 * 5/2016 Sobb ..... A47G 7/044
9,581,782 B2 * 2/2017 Abby ..... B65H 75/446
9,993,094 B1 * 6/2018 Franzone, Jr. ..... A47F 5/0807
11,825,963 B2 * 11/2023 Coan ..... B65D 5/48024
2007/0039907 A1 2/2007 Zandt
2008/0029471 A1 * 2/2008 Hurt ..... A47F 5/0815 211/119.004
2011/0155875 A1 * 6/2011 Hofman ..... A47G 25/06 248/220.31
2013/0334154 A1 12/2013 DeLuca et al.
2014/0061401 A1 3/2014 Bernstein
2025/0228377 A1 * 7/2025 Mun ..... A47F 5/0815

FOREIGN PATENT DOCUMENTS

FR 2874162 A1 8/2013
JP 1380012 2/2010
WO WO-2023069609 A1 * 4/2023 ..... A47F 5/0815

* cited by examiner

DISPLAY BOARD AND METHOD OF USE

The instant application claims priority as a non-provisional filing of U.S. provisional application 63/271,082 filed on Oct. 22, 2021, presently pending, the contents of which are hereby incorporated by reference.

BACKGROUND OF THE INVENTION

Field of Invention

The field of the invention is a system for a secure and attractive display of merchandise at the point of sale, including the ability to reconfigure the system to display products of various sizes and products with variable packaging.

Background

Customer products, such as beauty products, are often displayed at a point of sale on a store fixture. Conventional store fixtures are designed for a commercial environment and include fixed display prongs to prevent product damage or theft. Such displays are frequently used for products with standard package sizes, such as batteries.

Other systems include a backer board with round apertures on a grid (such as the apertures 30 in FIG. 1C and round apertures 112 in FIG. 1D) and prongs (such as the display prong 18 in FIG. 1B and the prong 118 in FIG. 1D) whose hooks 44 are engaged with the apertures for attachment to the backer board. These may be customizable to accommodate many different sizes of product packaging but are challenging to secure, as shown in the prior art view of FIG. 1D. To secure the prongs on a conventional display board system, the store operator generally must insert the hooks into the apertures from an upward angle, which is a difficult task for apertures in the upper rows of the backer board, and also use locks or attach the prongs to the side of the backer board to which the user does not have access.

A need exists in the art for a product display system that is both customizable and secure. A need also exists for a means that attaches display prongs to a display board at customizable locations.

SUMMARY OF INVENTION

An object of the invention is to create a display board system that overcomes many drawbacks in the prior art. A feature of the invention is that the display board allows for secure and customized use of a display wall, which is impossible with prior art systems. An advantage of the invention is that the display board can show products at a point of sale without concern for parts of the display board coming apart. An additional advantage of the invention is that the display board may be used optimally given the products to be displayed.

A further object of the invention is to provide a display board system that allows for the display of merchandise over the entirety of the backer board. A feature of the invention is that the product display prongs can be installed in arbitrary locations on the product display backer board. An advantage of the invention is that no row or column is unreachable on the backer board.

Another object of the invention is to create a display board system that can be used with various existing display prongs. A feature of the invention is that the novel aspects are substantially located on the backer board portion, which remains compatible with many existing display prongs. An advantage of the invention is that the display system user does not have to replace all components and can reuse existing display prongs.

Another object of the invention is to create a display board system that holds products in place in a secure manner. A feature of the system is that multiple holes in the display backer board are engaged when a product display prong is installed on the backer board. An advantage of the invention is that the display prongs are securely attached to the backer board but can still be reconfigured.

Yet another object of the invention is to provide a customizable display system that does not require locks and other complicated elements to be secure. A feature of the system is that it includes backer board apertures that prevent the removal of the product prongs.

Yet another advantage of the invention is that the display board includes elements to illuminate the products displayed on the system. A feature of the system is that sources of light can be added to designated apertures on the backer board. A benefit of the system is that it can improve the appeal of the products on display.

BRIEF DESCRIPTION OF THE DRAWINGS

The invention, together with the above and other objects and advantages, will be best understood from the following detailed description of the preferred embodiment of the invention shown in the accompanying drawings, wherein.

DETAILED DESCRIPTION OF THE INVENTION

The invention provides a product display system with a stationary display backer board and moveable product display prongs in various embodiments. The display backer board receives the display prongs as the display backer board includes suitable apertures.

The above summary and the following detailed description of specific embodiments of the present invention will be better understood when read in conjunction with the appended drawings.

As used herein, an element or step recited in the singular and proceeded with the word "a" or "an" should be understood as not excluding plural said elements or steps unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 1A:
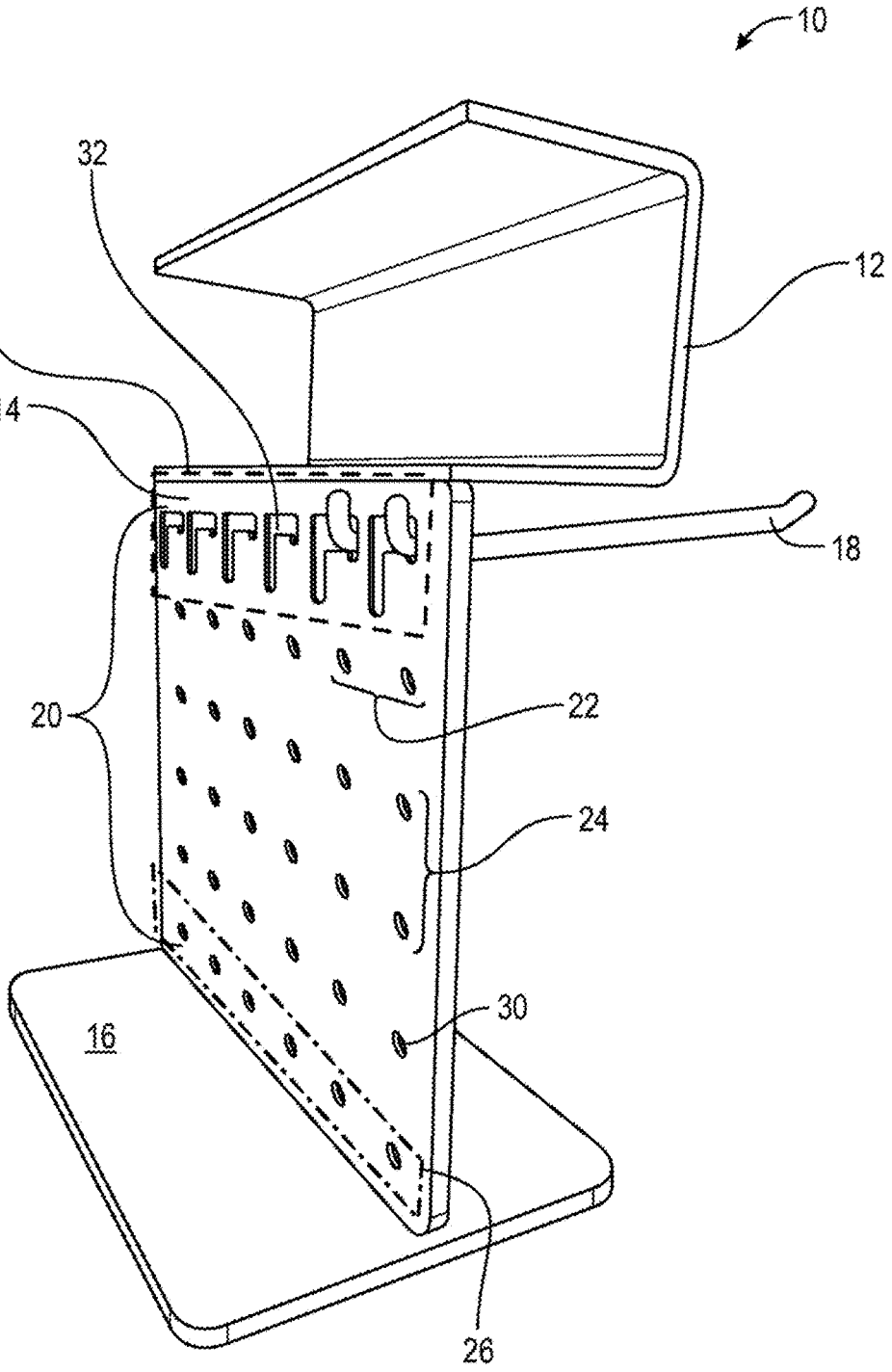
FIG. 1A depicts a side view of an embodiment of a display system pursuant to one embodiment of the invention.

Turning to the figures, FIG. 1A depicts a perspective side view of one embodiment of the invented display system 10. The display system includes a header 12, a backer board 14 (shown as being in a substantially vertical orientation), a base 16, and multiple product display prongs 18. As shown in FIG. 1A, the header 12 extends beyond the vertical plane defined by the front surface of the backer board 14. The backer board 14 is considered to be substantially vertical in that the face of the backer board 14 is substantially perpendicular to the base 16 and the header 12. However, the backer board 14, in some embodiments, is installed directly on a vertical substrate (such as a wall or room divider) and then the need for the base 16 or the header 12 is obviated.

While in FIG. 1A the display system 10 is shown to include both a header 12 and a base 16, in other embodiments, the display system 10 includes only a backer board 14, which is mounted directly on a vertical surface such as a wall or a post. Further, while the display system 10 is described as having a header 12 and a base 16, these elements may be integrally molded with the backer board 14 or be separate elements.

The backer board 14 comprises a matrix of apertures 20, spaced at regular horizontal intervals 22 and vertical intervals 24. In addition, the backer board 14 includes an area closest to the base 26 and an area closest to the header 28.

In the embodiment shown in FIG. 1A, the header 12 comprises a U-shaped piece of material, such as steel. The header 12 provides a way to secure the display system 10. It also provides bulk to the display system 10 so that the display system 10 does not tip over when loaded with products (not shown). The header 12 also provides a visual cue and provides a surface where information about the products displayed by the display system 10 may be located. The product information can include price and other important information about the merchandise. The header 12, therefore, provides critical information and serves an important function. In some point-of-sale applications, the header 12 also incorporates a light source that will illuminate the products. In some embodiments, the light source is electrically coupled to a motion detector and so will only illuminate the products if a potential customer approaches.

The matrix of apertures 20 includes substantially round apertures 30 and oblong apertures 32. In the embodiment shown in FIG. 1A, the multi-part oblong apertures 32 are used in the area closest to the header 28. In other embodiments, the multi-part oblong apertures 32 are used in multiple parts of the matrix of apertures 20. The details of the oblong apertures 32 are discussed below.

The product display prongs 18 are received at arbitrary openings in the matrix of apertures 20. The embodiment of the product display prong 18 shown in FIG. 1A requires two adjacent apertures to be mounted to the backer board 14. This creates a stable and secure connection between the product display prong 18 and the backer board 14.

Figure 1B:
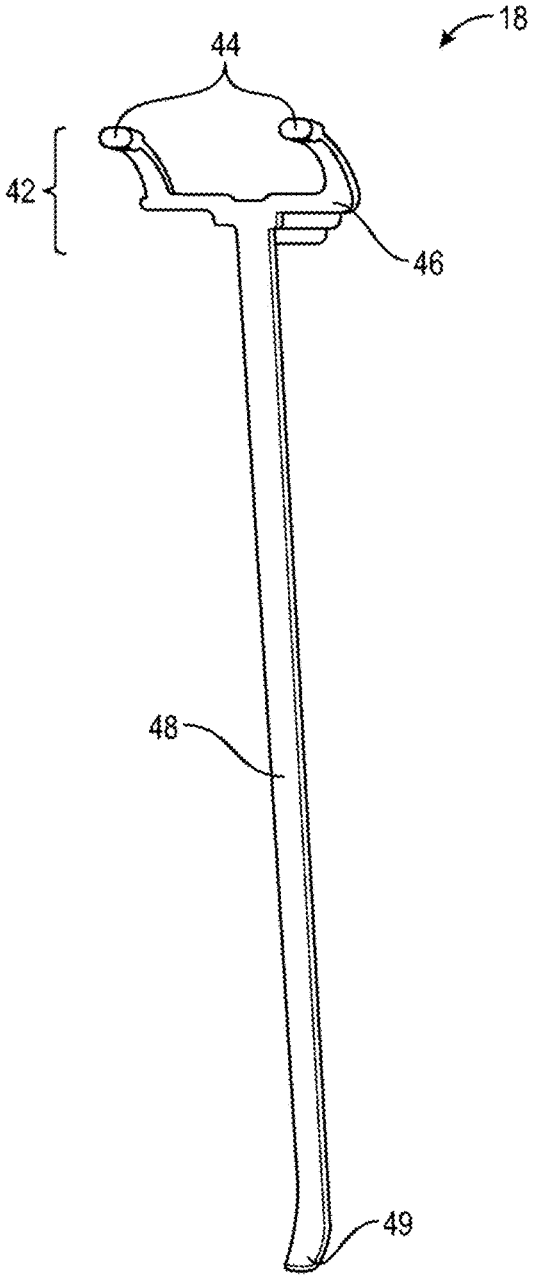
FIG. 1B depicts an overview of a display prong used in conjunction with an embodiment of the display system.

FIG. 1B is an overview of a product display prong 18 for use with the system. A benefit of the system is that it does not require custom display prongs 18 and is compatible with a number of display prongs, so long as they include the features described herein. The display prong 18, in one embodiment, comprises a single piece comprising Styrene Methyl Methacrylate Copolymers (SMMA 70/30). Display prongs 18 that comprise a single piece are easier to manufacture, and the material allows for cost-efficient manufacturing.

Each display prong 18 includes a header portion 42. The header portion 42 includes a pair of hooks 44 and an opposition surface 46. The opposition surface 46 engages with the backer board when the display prong 18 is installed on a backer board. The hooks 44 are spaced apart to correspond to the horizontal spacing of a backer board, such as the horizontal intervals 22 shown in FIG. 1A.

The display prong 18 also includes a horizontal member 48, which is used to display the products. In some embodiments, the horizontal member 48 ends in a curved tip 49 to prevent the product from falling out.

In one embodiment, the display prong 18 is integrally molded and made with materials such as SMMA 70/30 (a mixture of 70% Styrene Monomer (SM) and 30% Methyl Methacrylate (MMA)). In one embodiment, the header portion 42 comprises a different material. In this embodiment, the header portion 42 comprises a plastic, while the remaining parts of the display prong comprise a metallic material. A benefit of this system is that the display prong 18 can be manufactured as a single piece. There is no need to manufacture the header portion 42 and then movably attach the rest of the display prong to the header.

Figure 1C:
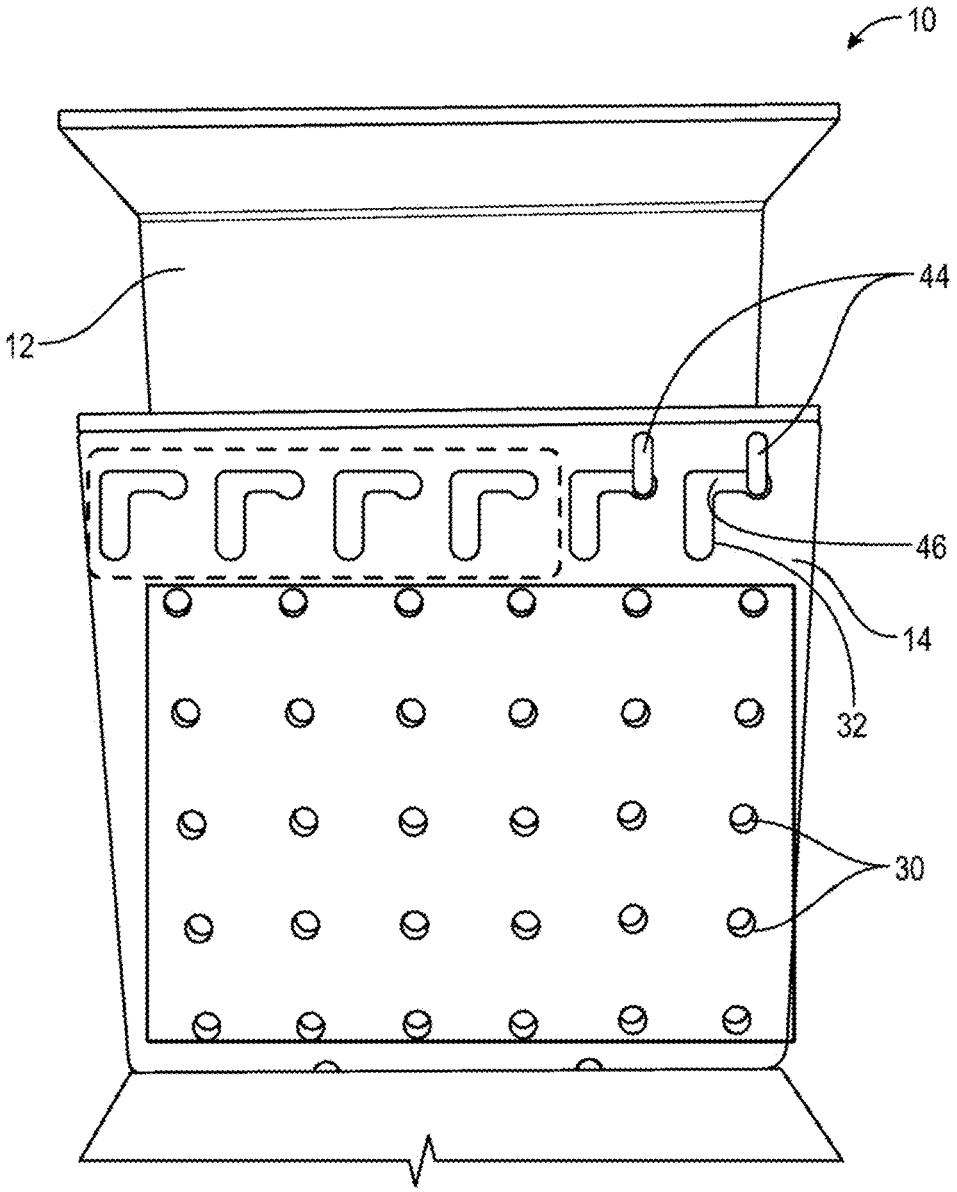
FIG. 1C depicts a back view of an embodiment of a display system, pursuant to one embodiment of the invention.

FIG. 1C shows the display prong installed on a backer board 14. The back of the header 12 is also visible in FIG. 1C, as are the hooks 44 of the display prong installed on the backer board 14. Visible through one of the oblong apertures 32 is the opposition surface 46.

The backer board 14 also includes substantially round apertures 30. The hooks 44 of each display prong 18 can be installed in either the substantially round apertures 30 or the oblong apertures 32. The benefit of the oblong apertures 32 is best understood with reference to a prior art backer board, as shown in FIG. 1D.

Figure 1D:
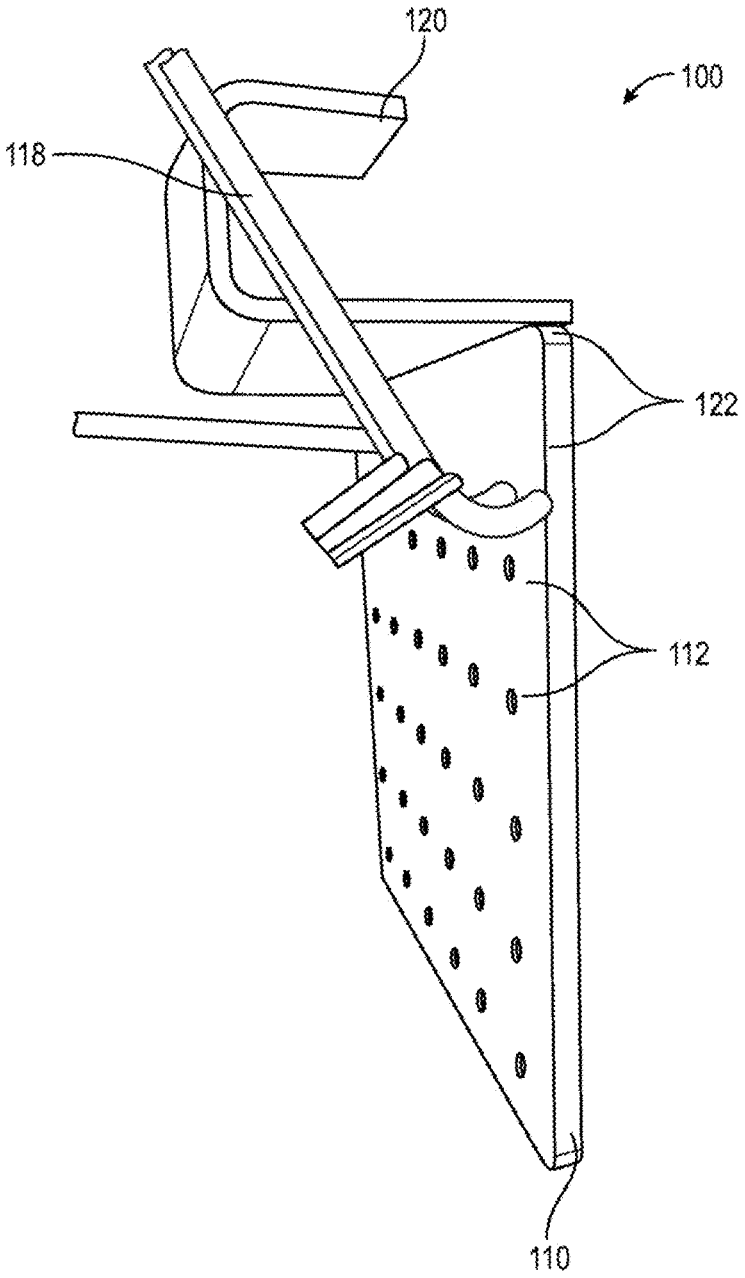
(Prior Art) FIG. 1D
FIG. 1D depicts a prior art display board.

FIG. 1D includes an embodiment of a prior art display board system 100. The prior art display board system 100 includes a backer board 110 with only round apertures 112. The display prong 118, which has to be tilted up to be installed on the backer board 110, will hit the header 120 when installed near the top of the backer board 110. As such, display prongs 118 that are exceptionally short can be installed in the portion 122 of the backer board 110 nearest the header 120, or that portion of the backer board 110 will be left empty, wasting space.

The area wasted on the backer board 110 is proportional to the distance the header 120 protrudes from the display wall. The longer the header 120 protrudes from the backer board 110, the more the area underneath the header 120 is wasted on the display wall because the end-user cannot use any of the round apertures 112 on the backer board 110 below the header 120 in the prior art devices Another way the area on the backer board 110 is wasted may be proportional to the length of the display prong 118. The longer the display prong 118, the end-user cannot use the prior art round apertures 112 on the display wall that are too close to the header.

Embodiments described herein obviate the need for any tilting actions, thereby avoiding wasted rows on the backer board.

A benefit of the system stems from the fact that the display prongs do not need to be tilted; display prongs that are already loaded with products may be installed on the backer board.

Apertures

Figure 2A:
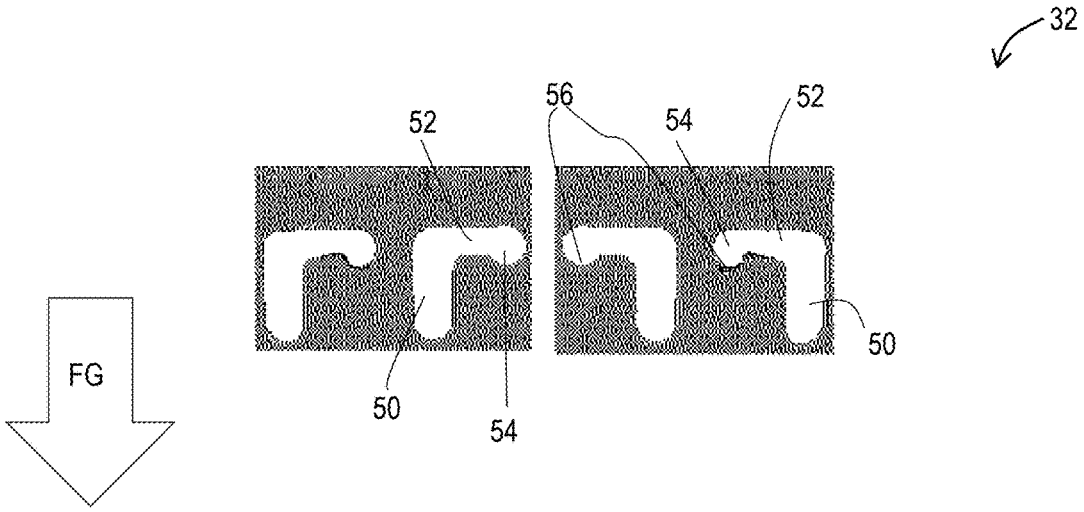
FIG. 2A depicts details of the apertures used in conjunction with a display system, pursuant to an embodiment of the system.

Details of the multi-part oblong apertures 32 are shown in FIG. 2A. The oblong apertures 32 allow for a display prong of an arbitrary length to be installed in any part of the display board.

The oblong aperture consists of an entry section, such as the depicted entry channel 50 where the display prong hooks are initially inserted. The entry channel 50 is large enough to accommodate the full height of the hooks on the product display prongs.

The oblong aperture 32 also comprises a perpendicular section 52 in communication with the entry channel 50. The perpendicular section 52 is substantially perpendicular to the entry channel 50. The perpendicular section 52 ends in a secure alcove 54, where the hook of the product display prong comes to rest after moving through the entry channel 50 and the perpendicular section 52. In at least one embodiment, the secure alcove 54 is substantially circular.

As can be appreciated from FIG. 2A, the entry channel 50, the perpendicular section 52, and the secure alcove 54 may be oriented in either direction.

FIG. 2A shows pairs of the oblong apertures 32 as the product display prongs generally require two apertures for balance. However, in some embodiments, the product display prongs require a different number of apertures.

Various arrangements of the elements are possible, such as having the entry channel 50 be oriented above the perpendicular section 52, in one embodiment (not shown). However, the load-bearing surface 56 of the secure alcove 54 must face against a force, such as the force of gravity FG. In other embodiments, a magnetic element is used to create a magnetic force which is then used in place of the force of gravity FG. The use of a magnetic element allows for multiple orientations of the secure alcove 54.

In another embodiment, the secure alcove 54 includes a frictional engagement element, such as a metallic flap (not shown). The metallic flap will exert a frictional force to act in place of, or in conjunction with, the force of gravity FG.

In one embodiment, each secure alcove 54 includes a connection to a low-voltage power source, alternating from positive to negative. The power connector provides power for an led light installed on the product display prong and lights up once the product display prong is installed on the backer board 14. In one embodiment, the conductors used to provide power act as securing clips by forcing the display prong against an opposing side of the secure alcove 54.

As can be appreciated from the embodiment shown in FIG. 1A, the oblong apertures 32 are generally used on the top row of the backer board 14. If the display prongs installed on the top row provide a light source, it will illuminate the entirety of the display, including the conventional display prongs below.

A benefit of the oblong apertures shown in FIG. 2A is that conventional substantially round apertures can be converted to multi-part oblong apertures. The round apertures form the secure alcove 54. The remaining components, the perpendicular section 52 and the entry channel 50, can be added using a drill or a rotary cutting tool with an appropriate template.

The shape of each aperture may vary and is not limited to it having a multi-part oblong shape, as shown in FIG. 2A. For example, in some embodiments, the apertures are in a zig-zag shape. In another embodiment, the aperture is designed so that the prong can be inserted while being rotated, and once inserted, the prong is securely held without tilting. FIGS. 2B to 2F depict several alternative embodiments for the apertures.

In one embodiment, the perpendicular section 52, the entry channel 50, and the secure alcove 54 are cut into the backer board substrate using a suitable cutting tool, such as a machine-controlled cutting bit. In another embodiment, the perpendicular section 52 and the entry channel 50 are cut using a cutting tool or laser, while the secure alcove 54 is formed by drilling into the substrate. Finally, in another embodiment, all three components are formed by drilling a series of interconnected holes, with a larger drill bit used for the secure alcove 54. In such an embodiment, the perpendicular section 52 and the entry channel 50 have boundaries that are not perfectly smooth and reflect areas where the drill bits overlap.

In one embodiment, the oblong apertures 32 are defined in a module and are not directly defined in the backer board 14. In one embodiment, the modules are snapped into apertures in the backer board 14.

Figure 2B:
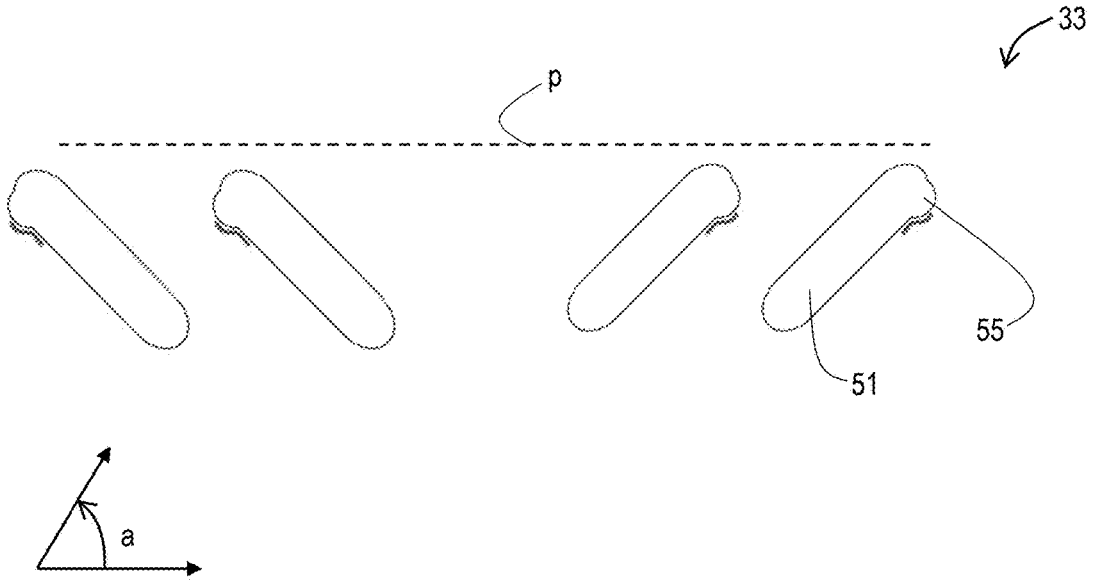
FIGS. 2B-2F depict details of alternative apertures used in conjunction with a display system, pursuant to an embodiment of the system.

FIG. 2B depicts additional alternative apertures which are not substantially round. The alternative apertures 33 also comprise a secure alcove 55 and an entry channel 51. However, the alternative apertures obviate the need for a perpendicular section 52 of FIG. 2A. Instead, the entry channel 51, which ends in the secure alcove 55 is at an angle a, with respect to the horizontal plane formed by the header p. As shown in FIG. 2B the angle a is less than 90 degrees and approximately between 40 and 55 degrees in one embodiment.

As can be appreciated by the embodiments in FIGS. 2A-F, the display prong may be secured in the alcove part of the aperture with its hook.

If the display prong is secured by the alcove, the display prong may be inserted into the apertures, which have a shape into which the hook can be inserted without requiring the display prong to be rotated or tilted. For example, in the embodiments in FIGS. 2A, 2C, and 2D, the display prong may be inserted into the entry channel 51 without tilting or rotating. The display prong may require vertical or horizontal motion, but it does not need to be tilted. In other embodiments, tilting is not required, but some rotation may be required. In several of the embodiments shown, the display prong is positioned by the secure alcove 55 formed in the apertures, as shown in the various figures.

Figure 2C:
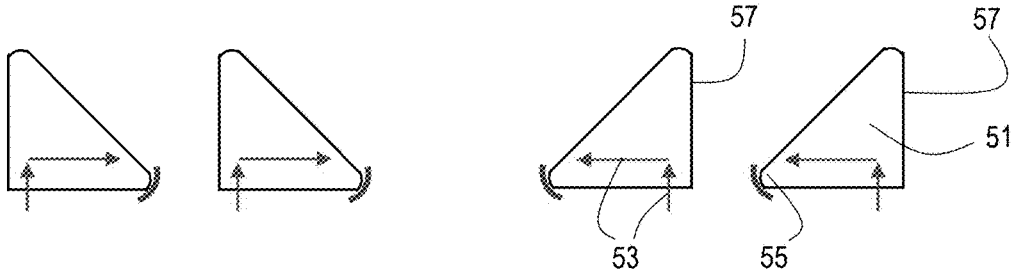
Figure 2D:
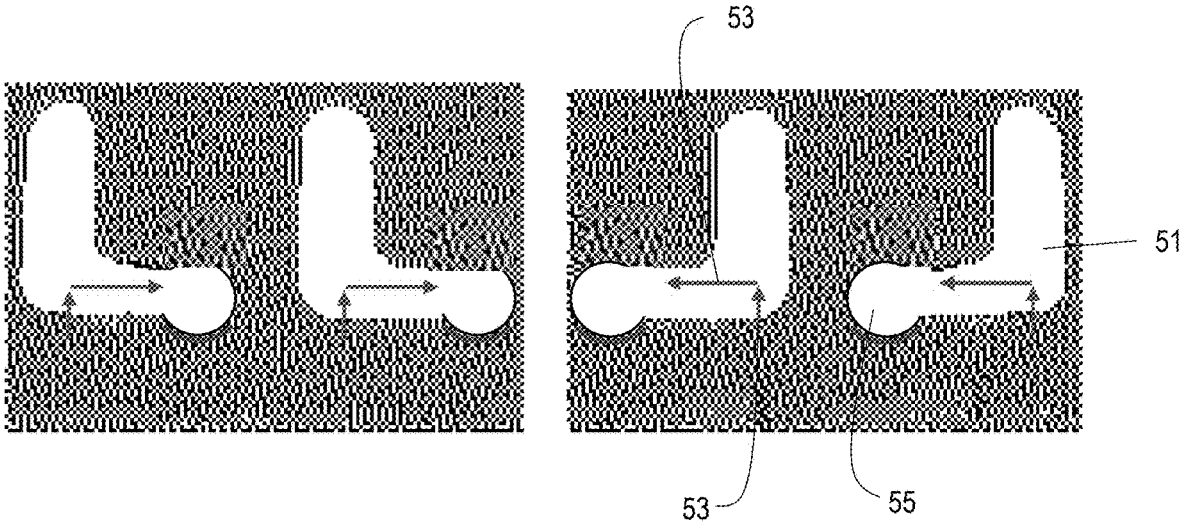
Figure 2E:
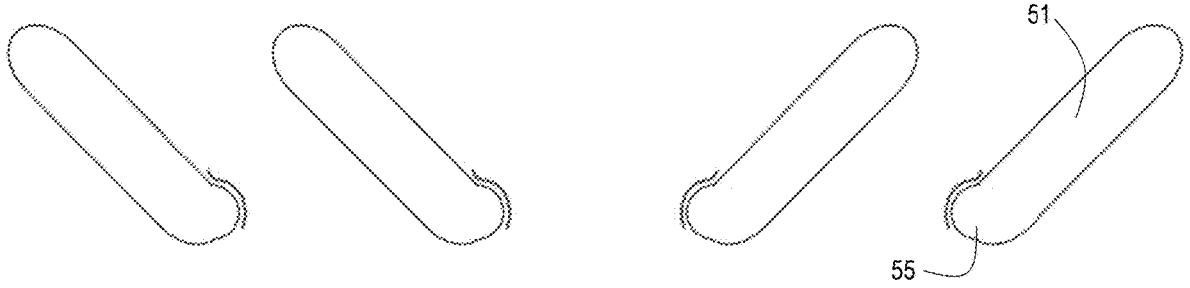

If the display prong is secured by the hook, the display prong may be first rotated or twisted a little to be inserted into the apertures, and the rotated or twisted display prong may be rotated or twisted back to the display prong's original position or angle so that the hook is secured on the display as shown in FIG. 2E. However, the display prong does not need to be tilted.

Figure 2F:
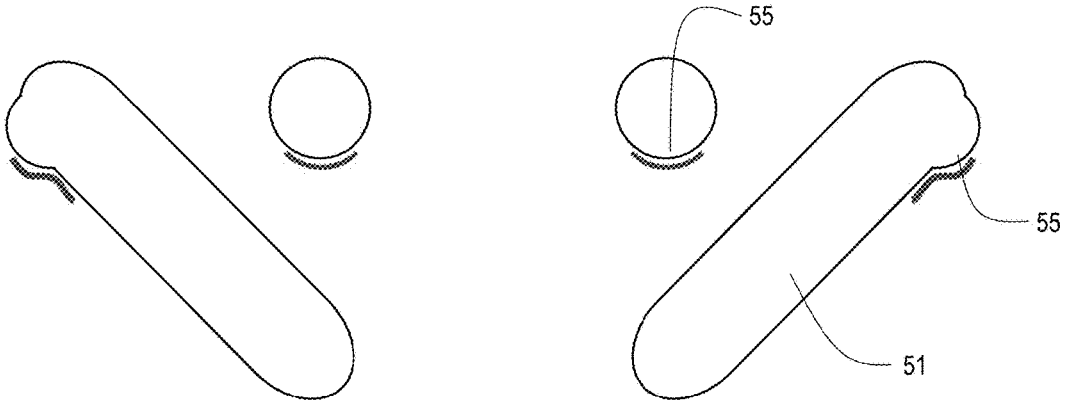

The display prong may be inserted into apertures by the movement to the side-either left or right movement instead of tilting up and down. In this case, the apertures may be formed, as shown in FIG. 2F.

In FIGS. 2C and 2D, the movement of the display prong into the aperture through the channel 51 into the secure alcove 55 is depicted by the arrows 53. As can be appreciated from the arrows 53, no tilting or twisting motion is required.

The embodiment of the aperture in FIG. 2C is substantially triangular. The adjacent arm 57 of the triangular aperture is sufficiently large to accommodate a hook on the display prong.

In one embodiment, in place of the secure alcove 55, a clip (not shown) presses down on the display prong to keep it in place.

The steps of adding the display prongs 18 to the backer board are shown in the sequence of FIGS. 3A-D.

Method of Use

FIGS. 3A-D show the steps in a method of use of the display system 10.

Figure 3A:
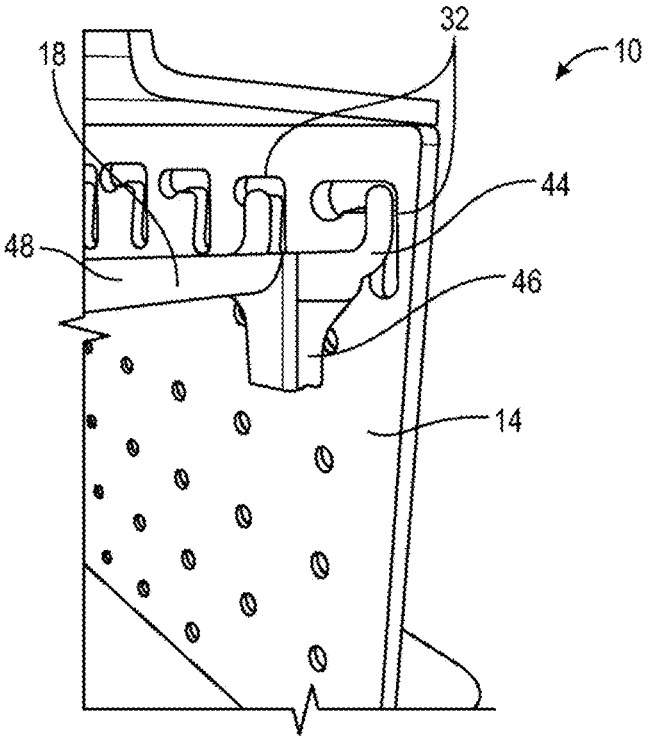
FIGS. 3A-D depict the steps of installing a display prong on the display system, per one embodiment.

In the first step, shown in FIG. 3A, the display prong 18 is brought in proximity to a pair of oblong apertures 32 on the backer board 14. Any pair of oblong apertures 32 may be chosen. The horizontal member 48 will extend from the opposition surface 46 at approximately the midpoint between the chosen oblong apertures 32.

As discussed above, other display prongs do not use a pair of oblong apertures. During the first step shown in FIG. 3A, the hooks 44 of the display prong 18 do not yet pass through the plane formed by the backer board 14 and its oblong apertures 32. Also, during this step, the opposition surface 46 does not contact the backer board 14.

Figure 3B:
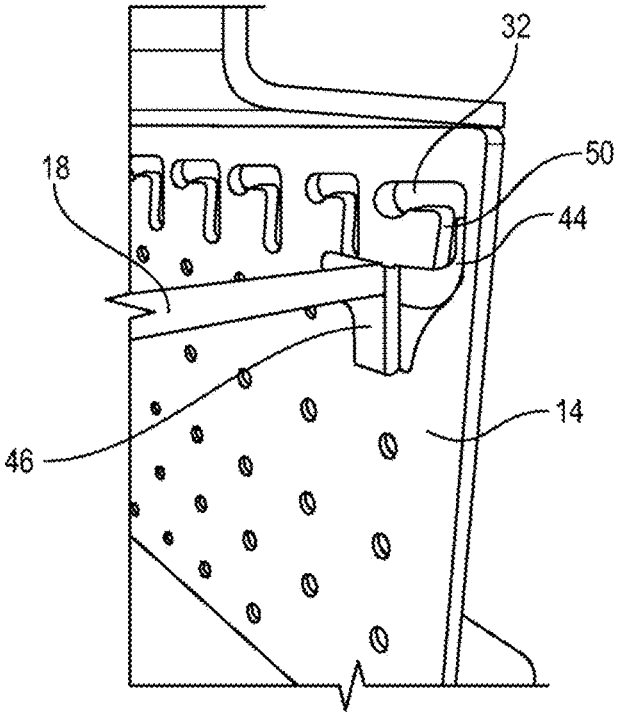

In the second step, shown in FIG. 3B, the display prong 18 is inserted through the oblong apertures 32 to the point where the opposition surface 46 makes contact with the backer board 14. The insertion of the display prong 18 ends when the opposition surface 46 prevents further movement towards the backer board 14. The hooks 44 pass through the oblong apertures 32 entry channels 50.

Figure 3C:
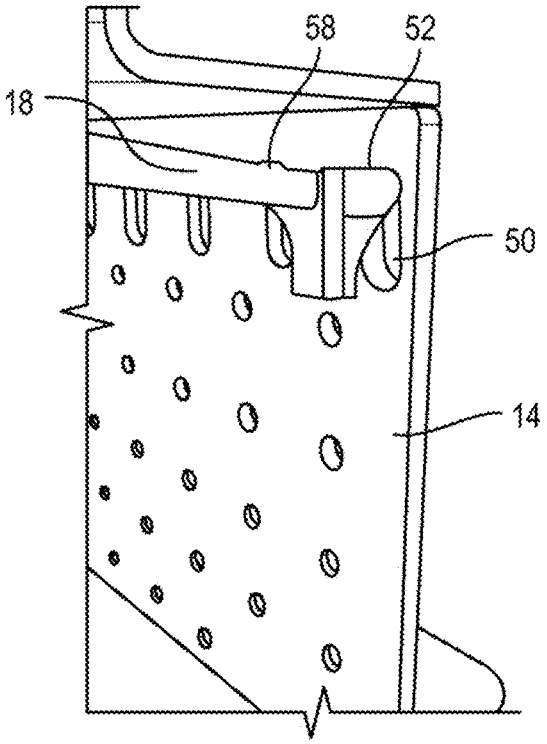

In the third step, shown in FIG. 3C, the display prong 18 is moved through the entry channels 50 to the perpendicular section 52. In the perpendicular section 52, the hooks are engaged with the reverse side of the backer board 14; however, the display prong 18 is not yet secure.

Figure 3D:
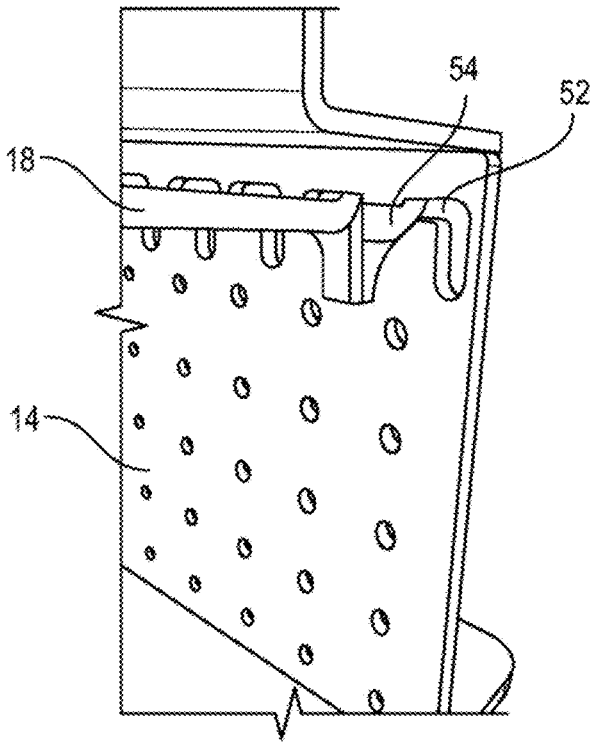

In the fourth step, shown in FIG. 3D, the display prong 18 is finally secured after moving through all of the perpendicular section 52 to the secure alcove 54. The display prong 18 will not move out of the secure alcove 54 without deliberate force being applied straight upward.

In some embodiments, after placing the display prong in the secure alcove 54 the display prong is secured in the location by the action of a metallic clip (not shown) present in the secure alcove 54. In this embodiment, the display prong 18 cannot be moved out of the secure alcove 54 without first releasing the clip. In one embodiment, access to the clip is only from the reverse side of the backer board 14.

As can be appreciated from FIGS. 3A-D the display prong 18 can be installed on the backer board 14 without any tilting motion. In this way, the prong 18 will not be blocked by the header, as is the case with the prior art shown in FIG. 1D.

As shown in FIG. 3C, the prong 18 includes a product alignment protrusion 58 along the length of the prong 18, in at least one embodiment. The product alignment protrusion 58 provides physical feedback if the product (not shown) is pushed too far back on the prong 18.

In one embodiment, not shown, the prong 18 includes a series of product alignment protrusions of various geometric configurations. In one embodiment, the protrusions increase in height, such that increasing amounts of force are required to slide products on the prong. While not detected by the end customer, this variable amount of force can be sensed by a robotic arm loading products on the prong 18.

A benefit of the embodiments is that the installation of the display prongs requires several movements in specific directions, in a specific order. This complex movement ensures that the display prongs will not get knocked out simply by being bumped or moved in only one direction.

It is to be understood that the above description is intended to be illustrative and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting but are instead exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the terms "comprising" and "wherein." Moreover, in the following claims, the terms "first," "second," and "third," are used merely as labels and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

The embodiment of the invention in which an exclusive property or privilege is claimed is defined as follows:

1. A display system comprising:

a backer board having at least one aperture; and at least one display prong received by the backer board;

wherein the at least one aperture comprises a secure alcove adapted to receive the display prong without requiring the display prong to be tilted;

wherein the at least one aperture further comprises an entry section that is in communication with the secure alcove, and the at least one display prong is adapted to be initially inserted into the entry section without being tilted and then moved to the secure alcove; and wherein the entry section is positioned below the secure alcove.

2. The system of claim 1 wherein the at least one aperture further comprises a perpendicular section in communication with the entry section, ending in the secure alcove.

3. The system of claim 1 wherein the entry section is angled.

4. The system of claim 3 wherein an angle of the entry section with respect to a horizontal plane is between 40 and 55 degrees.

5. The system of claim 1 further comprising a header provided on top of the backer board.

6. The system of claim 5 wherein said header extends beyond a vertical plane formed by the backer board.

7. The system of claim 1 wherein said aperture adapted to receive the display prong is substantially triangular.

8. The system of claim 1 wherein said secure alcove is substantially circular.

9. The system of claim 1 wherein said secure alcove receives a hook of a display prong.

10. The system of claim 1 wherein the backer board further comprises a plurality of round apertures arranged in a matrix.

11. The system of claim 1 wherein the system further comprises a base provided underside of the backer board.

12. The system of claim 1 wherein the display prong is adapted to be installed on the backer board without rotating.

* * * * *